United States Patent [19]

Bonetti

[11] 4,129,153

[45] Dec. 12, 1978

[54] LOOM FOR WEAVING

[75] Inventor: Danillo Bonetti, Jerago con Orago (Varese), Italy

[73] Assignee: Bentley Engineering Group, Ltd., United Kingdom

[21] Appl. No.: 765,616

[22] Filed: Feb. 4, 1977

[30] Foreign Application Priority Data

Feb. 10, 1976 [IT] Italy ..... 20024 A/76

[51] Int. Cl.[2] ..... D03D 47/00

[52] U.S. Cl. ..... 139/28; 139/11

[58] Field of Search ..... 139/11, 20, 28, 48, 139/429, 435, 443, 444, 445

[56] References Cited

U.S. PATENT DOCUMENTS

| | | | |
|---|---|---|---|
| 775,571 | 3/1904 | Gray | 139/445 |
| 2,392,489 | 1/1946 | Martin | 139/28 |
| 2,742,058 | 4/1956 | Gentilini | 139/444 |
| 2,893,440 | 7/1959 | Brusadelli | 139/28 |
| 3,848,642 | 11/1974 | Steiner | 139/48 |

*Primary Examiner*—Henry S. Jaudon
*Attorney, Agent, or Firm*—Bucknam and Archer

[57] ABSTRACT

A loom is described which comprises a drum rotating on a rotary shaft, means for feeding the warp threads on the drum, means for inserting weft threads into sheds formed by the warp threads, peripheral weft bobbins and means for collecting the woven cloth. The drum consists of two first coaxial discs spaced one from the other at a predetermined distance, along the shaft, a plurality of second discs arranged in rows and mounted between the two first discs, each of the second discs having a first pulley portion and a second pulley portion, the first pulley portion being of greater diameter and the second pulley portion being of smaller diameter and one of the warp threads alternately goes over the pulley portion of smaller diameter and then the pulley portion of larger diameter while another warp thread alternately goes over the pulley portion of larger diameter and then the pulley portion of smaller diameter to form a crossed pattern. The second discs are carried by spindles arranged axially at equal distance from the shaft and form a cylindrical surface coaxial with the shaft. A pair of third discs mounted on the shaft carries means supporting the peripheral bobbins and means for guiding and tensioning the weft threads; the means for inserting weft threads into the crossed patterns formed by said warp threads are mounted on a second rotatable drum coaxial with the first drum. The second drum consists of two coaxial fourth discs and the means for inserting weft threads comprise a plurality of lances mounted peripherally on the second drum and a plurality of guides mounted between the fourth discs. The lances have a projection and the loom comprises means for imparting oscillatory motion to the lances in an axial direction.

7 Claims, 11 Drawing Figures

Fig. 6
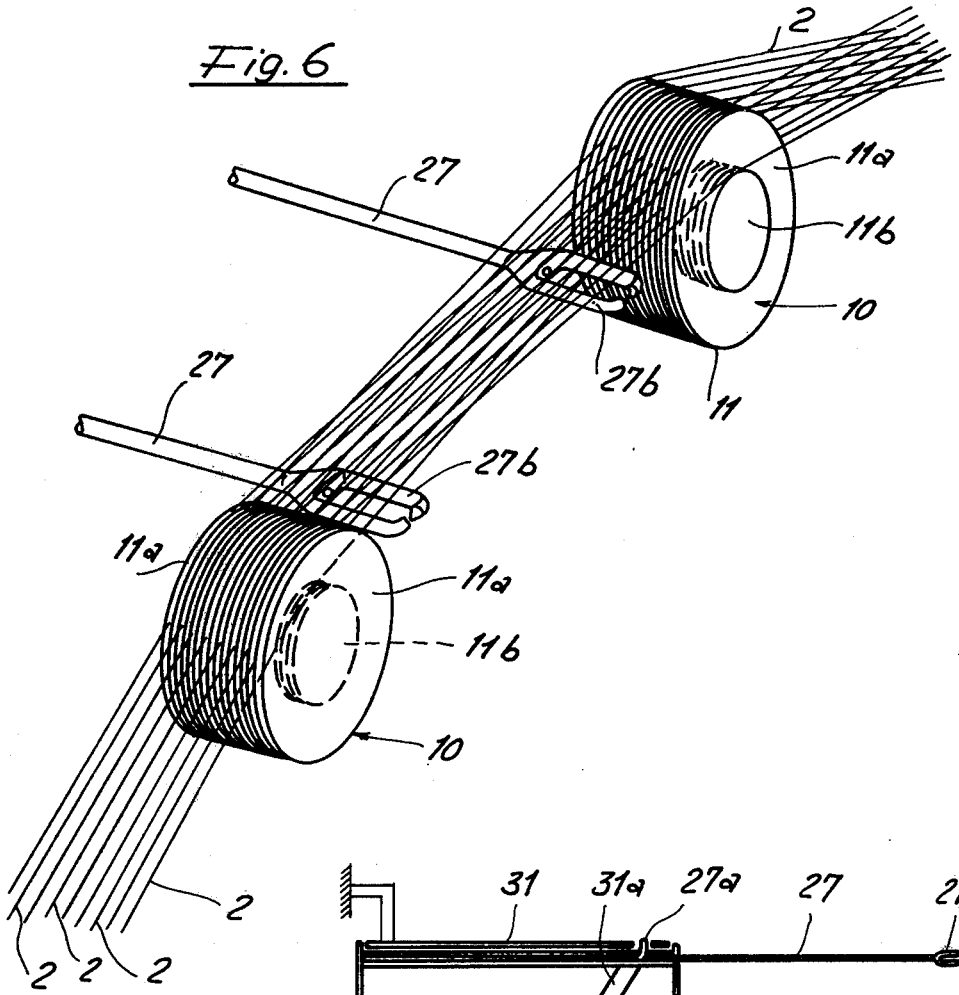
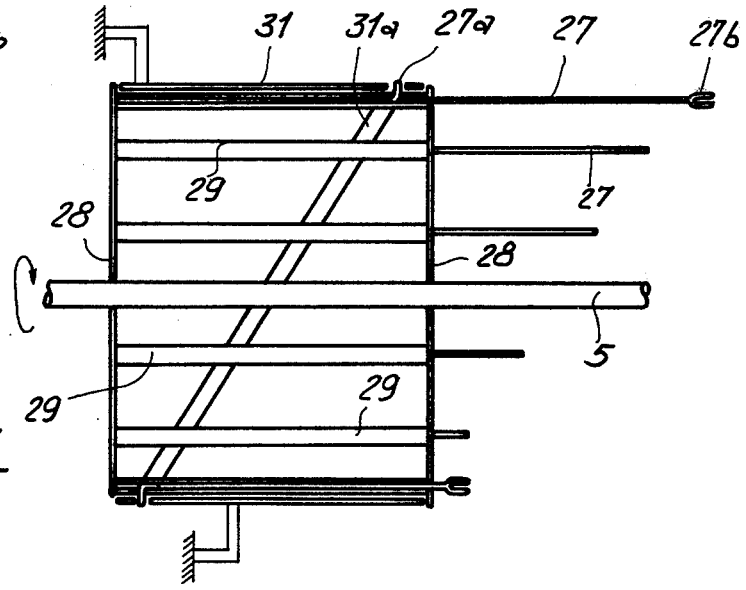
Fig. 3

LOOM FOR WEAVING

This invention relates to a loom for weaving, operating with a plurality of warp sheds.

As well known, in the traditional looms for weaving, the warp threads are partly raised and partly lowered in a suitable manner by means of proper structures in order to build a shed, transversely of which a weft thread may fit.

The latter is carried on a side and the other of the cloth is formed by means of shuttles, grippers, fluid jets and the like, performing together with the warp specific braidings. The hourly production of the cloth depends consequently strictly on the speed at which it is possible to effect the insertion of the weft threads between the warp threads.

Such speed has been in fact progressively increased by replacing the shuttles by more suitable conveying systems for the weft thread.

Practically, however, it is not possible to exceed determined production limits, which depend on the shed forming times.

The aforesaid operating limitation is instead obviated by the particular loom for weaving according to the present invention.

The loom according to the present invention is in fact structurally built so that the warp builds simultaneously a plurality of sheds through which so many weft threads may be inserted in a suitable succession.

By the said arrangement it is possible in practice to obtain a considerable increase in the feeding speed of the warp threads and consequently a considerable increase in the hourly production of the cloth.

More in detail, the loom for weaving of the present invention includes a drum, consisting of two first coaxial discs of suitable diameter and conveniently spaced from each other. Rows of small second discs are arranged side-by-side along the periphery of the first discs and between them. These small discs are provided with a first pulley-like and a second pulley-like portion which is integral with the first one and which is of smaller diameter than the first portion.

The two pulley-like portions have an equal thickness and are adapted to sustain the warp threads in the respective throats, guiding them and holding them spaced from each other, which in the sections where they are subtended, build so many sheds according to a crossed pattern, between the various rows of side-by-side arranged discs.

Through the said sheds there are inserted the weft threads by means of fluid jets, or grippers, subjected to a suitable rotary-translatory motion, so as to be adapted to the rotary motion of the disc rows themselves.

These and further characteristic features, of a functional and constructional nature, of the loom for weaving being the subject of this invention may better be understood from the following detailed description, taken in conjunction with the various figures on the accompanying drawings, in which:

FIGS. 3 and 4 show designed in a longitudinal section the apparatus adapted to impart the rotary-translatory motion to the grippers carrying the weft according to two embodiments of the invention;

FIG. 6 shows in a perspective view a pair of the same disc rows;

Figure 1:
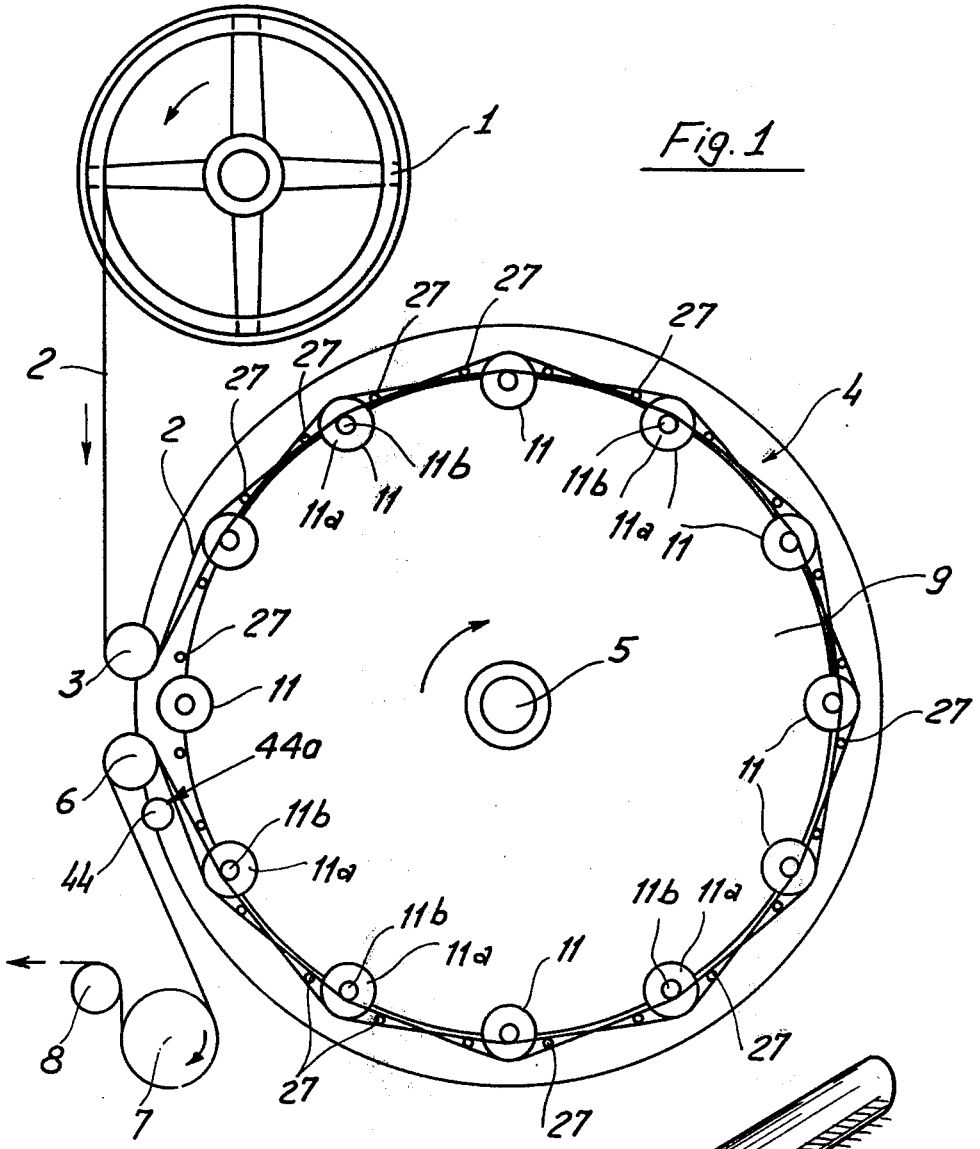
FIG. 1 shows in a schematic form a cross section of the said loom according to this invention.
Figure 9:
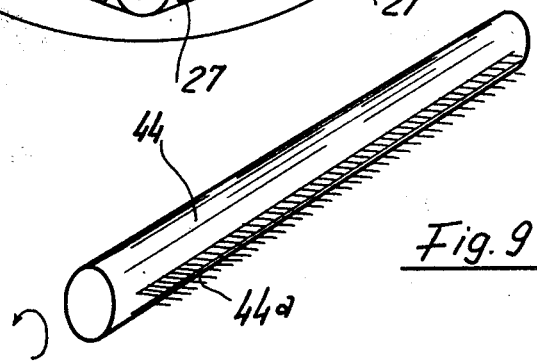
FIG. 9 depicts in a perspective view the rotary comb.

Referring now particularly to the numeral references given in the various figures on the accompanying drawings, and particularly FIG. 1, the loom for weaving of this invention includes a beam 1 for feeding the warp threads 2, which, through the return roller 3 are subtended on a drum 4, keyed on a rotary shaft 5.

Such warp threads pass on a second return roller 6, placed in proximity of the aforesaid return roller 3 and subsequently on a piece stretching roller 7 and on a further return roller 8 to be wound finally on a collection beam (not shown in the figures). The aforementioned drum 4 consists of two coaxial discs 9, (FIG. 2) keyed, at a certain mutual distance from each other, on the shaft 5, between such discs being mounted peripherally the rows 10 of side-by-side arranged discs 11.

Figure 5:
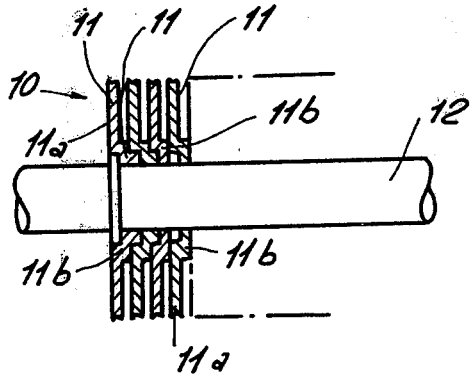
FIG. 5 illustrates partially in longitudinal section one of the rows of discs arranged side-by-side, for support and sliding of the warp threads.

As shown in FIG. 5, the spindles 12 carrying the aforesaid disc rows are disposed axially, at regular intervals from each other and at an equal distance from the shaft 5 so as to be arranged on a cylindrical surface, being coaxial with the shaft 5 itself.

As shown in FIGS. 1 and 6, each of the said discs 11 includes a first portion 11*a* having a pulley-like configuration and a second pulley-like portion 11*b* of suitably smaller diameter.

The said pulley-like portions 11*a* and 11*b* have equal thicknesses being very thin and sustain in the respective throats the warp threads 2 by a suitably braided pattern so as to define a plurality of sheds, adapted to ensure the cross insertion of the weft threads.

The shaft 5 on which there is keyed the drum 4 is set in rotation via a chain drive 13 or another suitable system, via a speed change gear 14, driven in turn by an electric motor 15.

Figure 2:
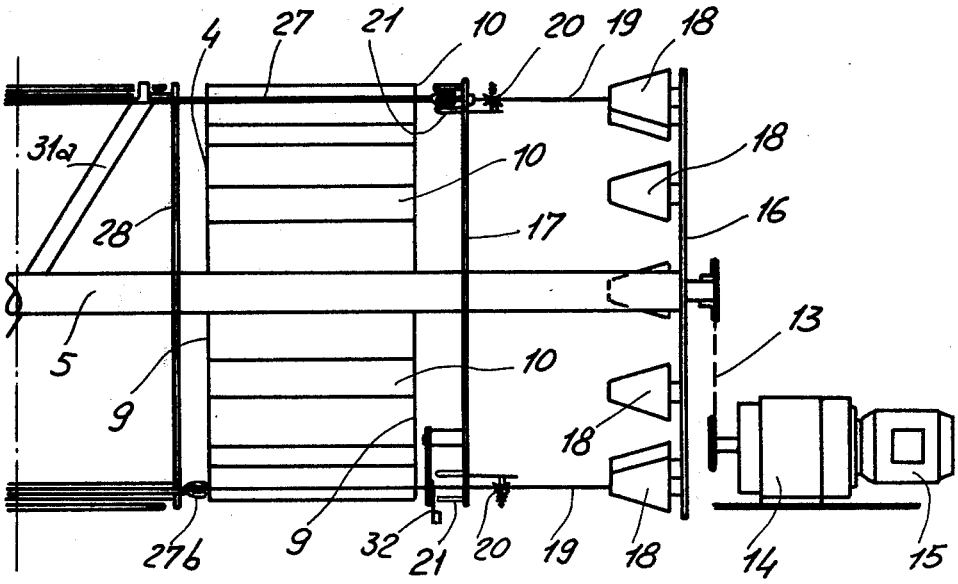
FIG. 2 represents a vertical section of the same loom as above.

As shown in FIG. 2, on the same shaft 5 is keyed further a pair of suitably spaced discs 16 and 17, the first of which peripherally supports a plurality of equidistant bobbins 18 for the weft threads 19. The said bobbins may be in particular mounted in a number of two, three units or more on rods, which may rotate by release, journaled peripherally to the support disc 16. The bobbins are mounted on rods provided for on the peripheral portion of the disc 16. By the abovementioned arrangement it is possible to change at will the weft colors within a comprehensive range of available colors by turning via suitable mechanisms the reel carrying structures.

On the disc 17 there are mounted the thread tensioners 20 being in alignment with the aforementioned bobbins, as well as small-sized blocks 21 serving as guide and retention of the weft threads 19, the said blocks being provided in a number being equal to that of the bobbins themselves.

Figure 7:
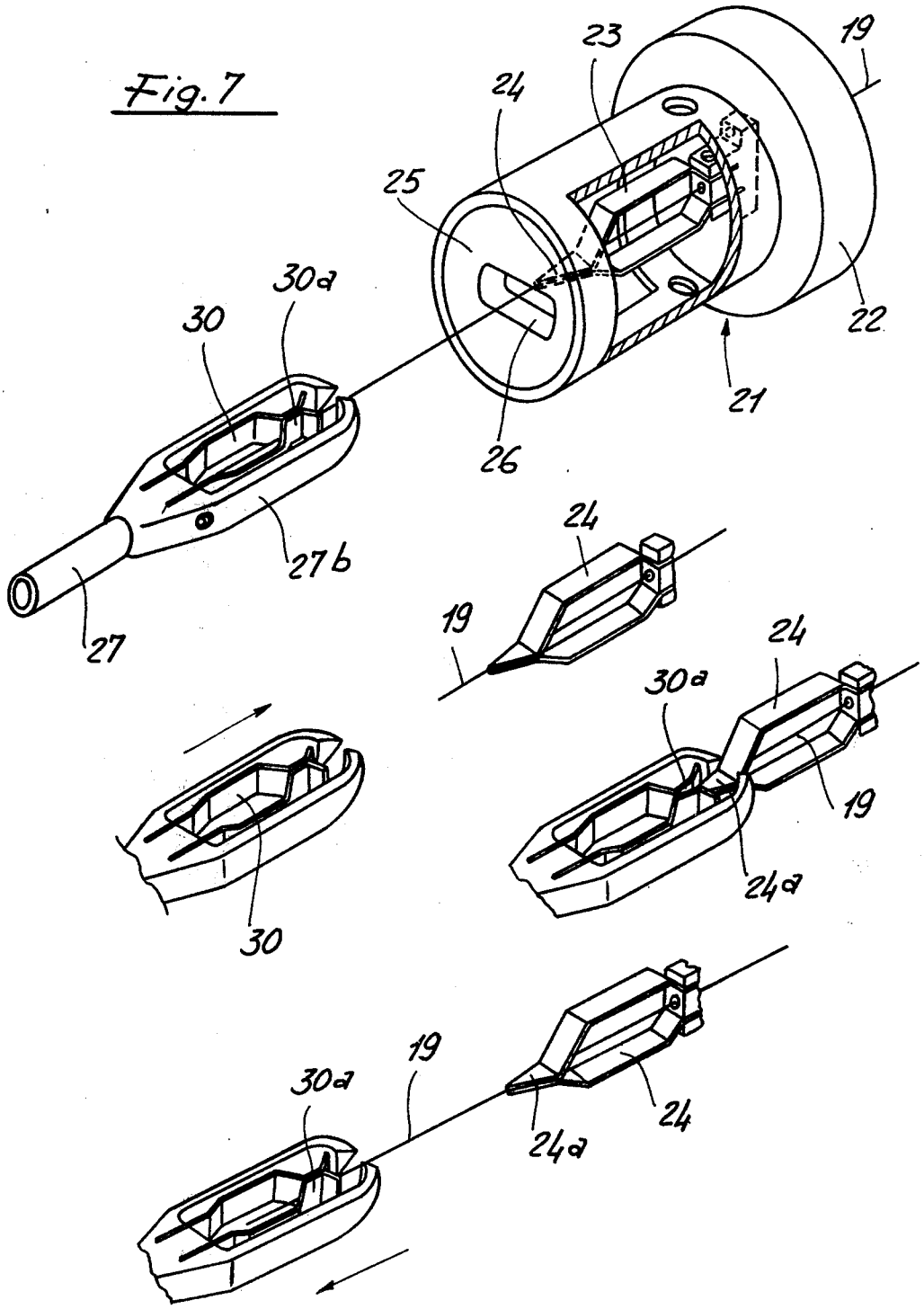
FIG. 7 illustrates the grippers which are used to convey the weft threads.
Figure 10:
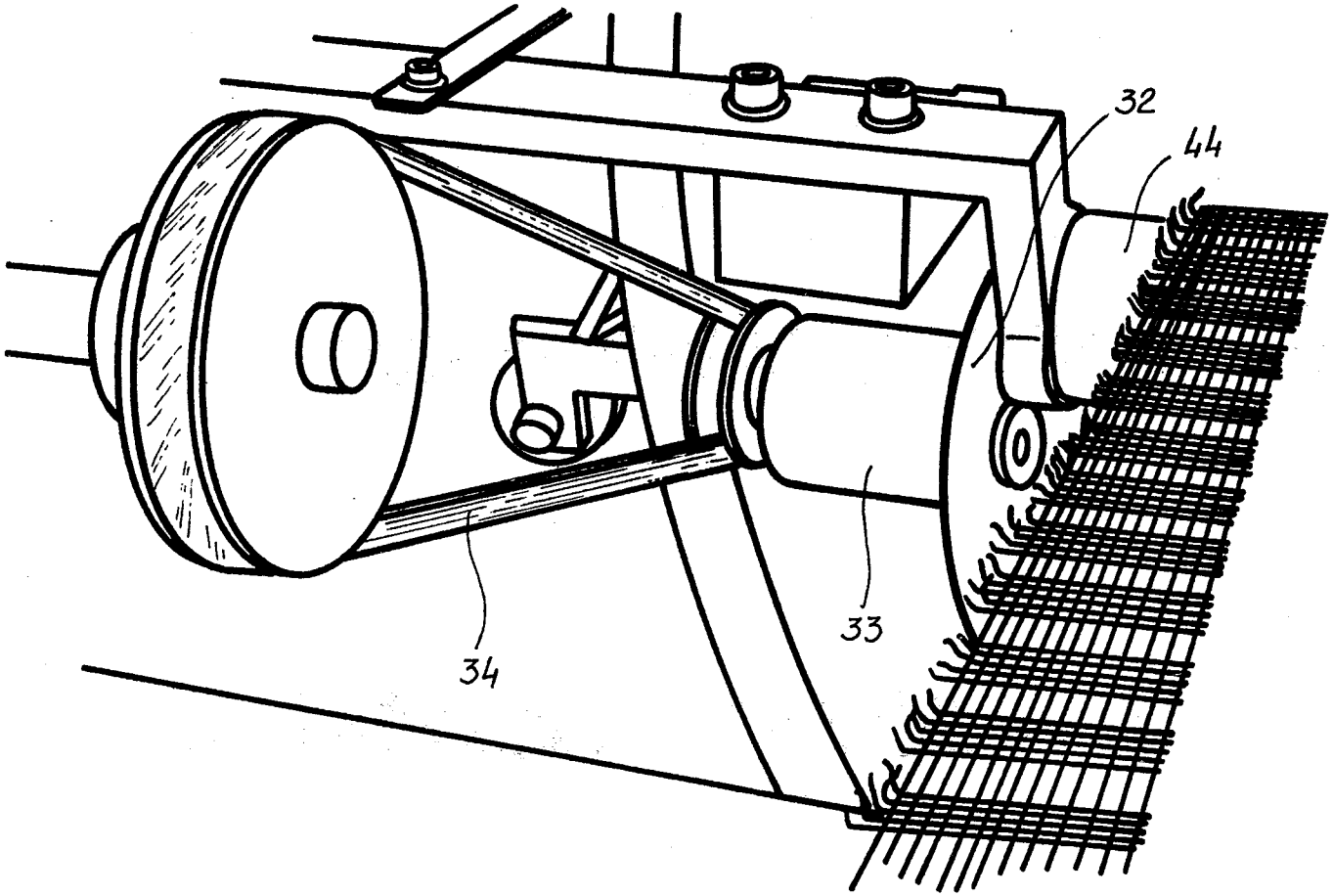
FIG. 10 illustrates the cutting assembly of the weft threads.
Figure 11:
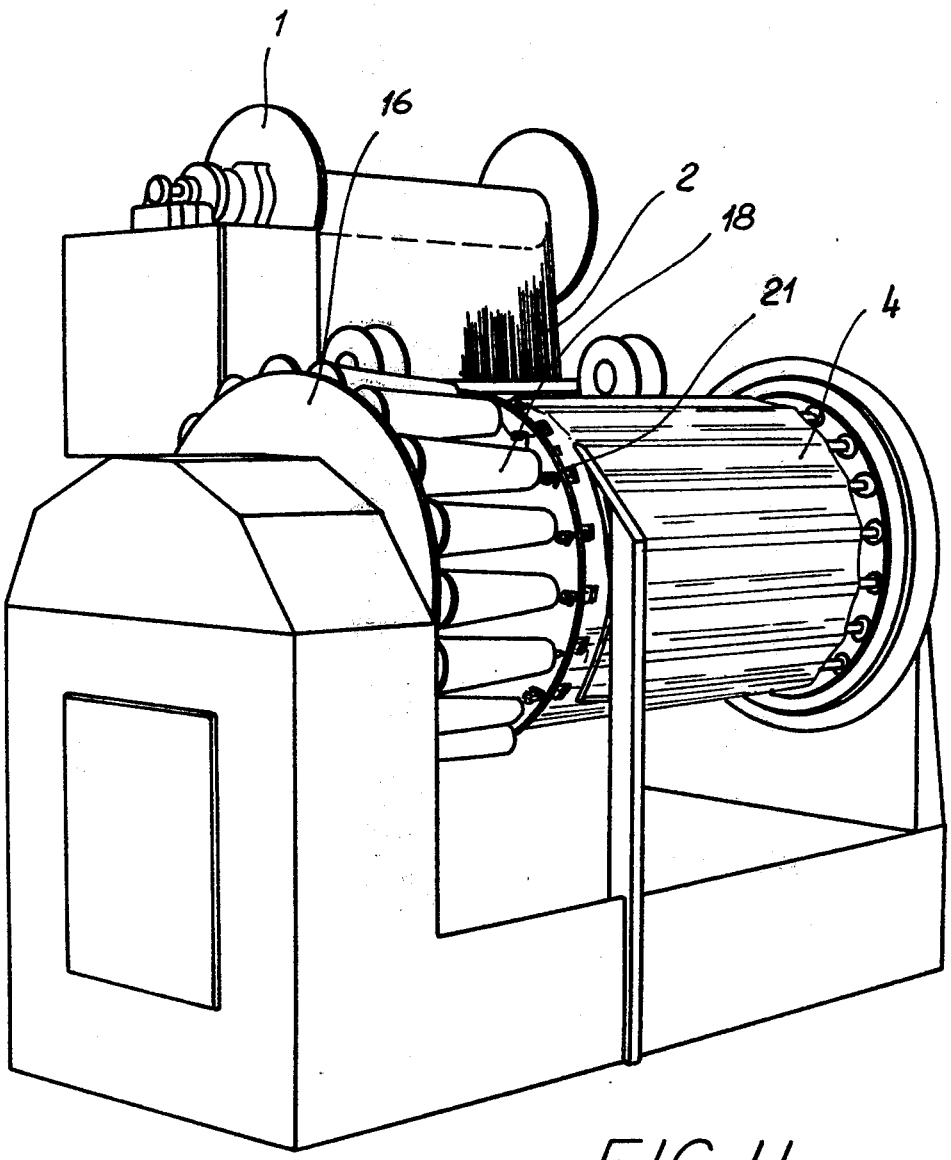
FIG. 11 is a perspective view of the entire loom.

As shown in FIG. 7, each of the said blocks 21 shows a hollow cylindrical structure disposed with the axis parallel to the axis of the shaft 5 and is fixedly secured to the disc 17 via a base body 22.

In the cavity of the block 21 there is located gripper 23, accessible through a lateral opening consisting of two symmetrically opposed C-bent springs, terminating with point-shaped portions 24*a*.

The point-shaped portions retain the weft thread 19 and are turned overhanging towards the bottom 25, which is provided with an eyelet 26, through which the weft thread itself comes out.

Figure 4:
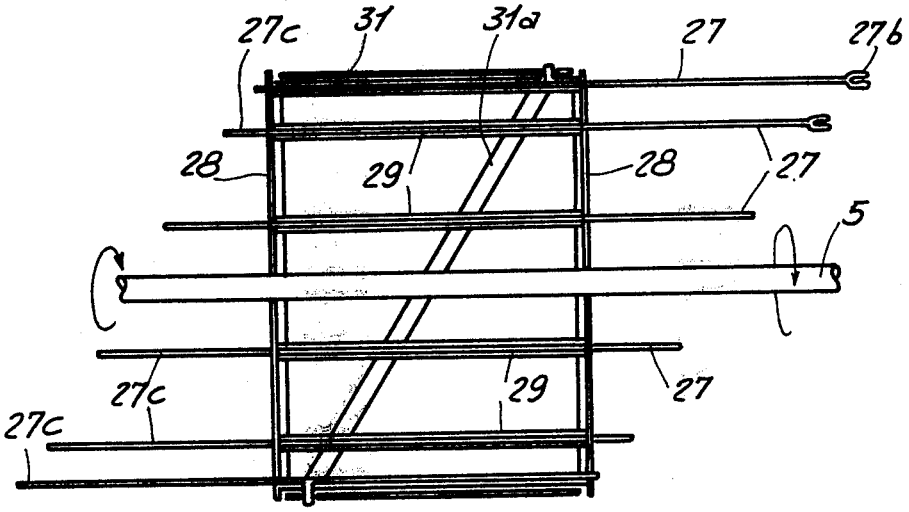

The various weft threads are inserted into the warp sheds via a plurality of lances 27 peripherally mounted in axial direction and at regular intervals on a rotary drum, keyed on the shaft 5. FIGS. 2, 3 and 4 show that the said drum includes two discs 28, integral with the shaft 5 and placed at a certain distance from each other, between which there are peripherally fastened in axial direction the guides 29 to ensure the sliding of the aforementioned lances.

As shown in FIGS. 3 and 4 each lance consists of a rod, provided with a side projection 27*a*, jetting out through a longitudinal slot of the corresponding guide 29, and an end fork-shaped portion 27*b*. The motion of the lances is sufficient to move the fork-shaped portion 27*b* from the position in which it has grasped the thread 19, as shown in the upper part of FIG. 2, to the position in which the same thread has crossed the warp threads which go through drum 4, as shown in the lower part of FIG. 2. Drum 31 is made up of two units both of which are supported as shown in FIG. 3. The said end fork-shaped portion is adapted to penetrate the block 21 through the eyelet 26 and comprises a gripper means or springs 30, similar to the pliers 24 referred to above, and rotated 90° relative thereto.

More in detail, the grippers 30 are made up of two symmetrically opposite springs, which comprise two end portions 30*a*, adhering therebetween springingly and terminating with stress curved edges.

Obviously, the force of the springs 30 should be greater than the force of the springs 24 so as to retain the weft thread, dragging it along the warp shed.

The lances 27 may be provided with related projections 27*a* as shown in FIG. 3, or show an extension 27*c*, as shown in FIG. 4 so as to be likely to carry a second gripper.

The oscillatory motion of the said lances is performed via a stationary drum 31, coaxial with drum 4 provided with a groove 31*a* in which the projections of the lances 27*a* themselves may slide.

The said groove is ring-like and is inclined relative to the shaft 5. The axial displacement of the lances 27 occurs because the lances are mounted on a rotating drum formed by discs 28 while the projections 27*a* slide in the groove 31*a* of the stationary external drum 31.

The cut of the weft threads 19 is carried out via a stationary cutting member, arranged at the inner dead-point of the trajectory of the lances referred to above, corresponding to a full insertion of the weft into the warp shed.

Figure 8:
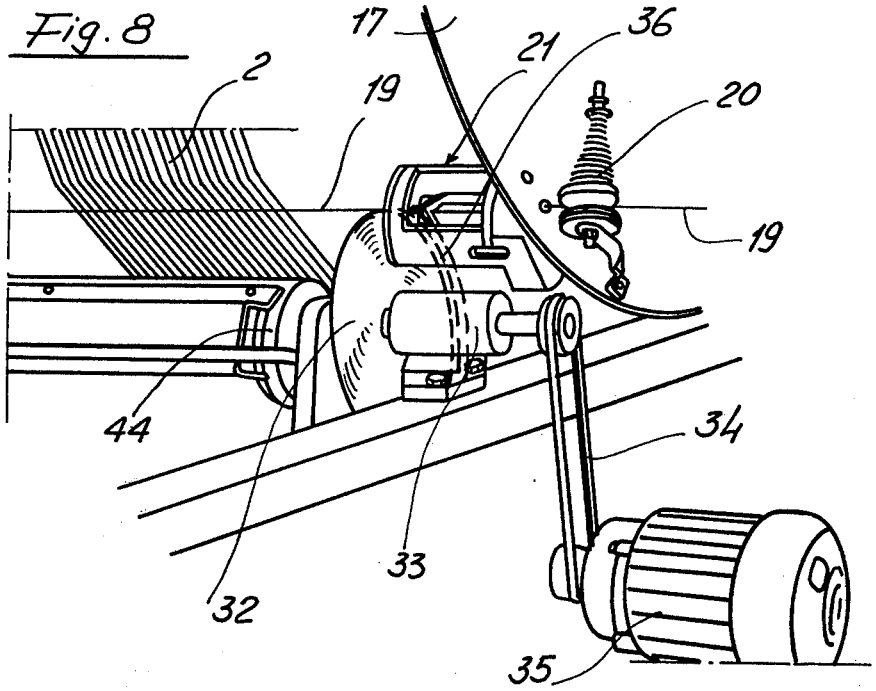
FIG. 8 illustrates the device which carries out the cut of the said threads.

Such cutting member consists of a circular knife 32, mounted on the bearing 33 and set in rotation by means of a generic drive belt 34 via en electric motor 35. The cutting devices are eccentrically fixed onto rotary disc 17 as shown in FIGS. 2 and 8. The cutting devices are mounted in the proximity of the block 21, one for each block, 12 in number in the illustrated example.

Peripherally of the said knife there is disposed in an adequate position an arcuate thread-guide 36, adapted to push the weft thread on the edge of the knife itself which effects the cut thereof.

In order to bring the weft threads close to each other after their insertion between the warp threads there is provided a roller 44, fitted with a projecting comb 44*a* and mounted rotating at the return roller 6.

Upon rotation of the roller 44 related comb 44*a* cyclically fits between the warp threads, thereby imparting a convenient density to the weft threads.

It should finally stressed that also the various rows 10 of discs 11 may be mounted in a number of two or more on rotary supports, journaled peripherally to the discs 9 so as to ensure the execution of a plurality of differentiated weaves. The apparatus functions as follows: The warp threads go onto drum 4 and specifically discs 11 so that they are spaced all along the drum. The peripheral speed of drum 4 is the same as the speed of warp threads 2. At the end the warp threads go over rollers 6 and 7. The weft threads 19 are inserted through the sheds by means of lances 27 which are alternately displaced in an axial direction. The axial displacement of lances 27 is achieved because they are mounted to slide axially on a rotary drum formed by discs 28 and guides 29. Projections 27*a* slide in the groove 31*a* of the stationary external drum 31. The lances grasp weft threads 19 which are brought by bobbins 18, carry them across the warp threads. Finally the weft threads are cut by the cutting assembly.

From the foregoing description and from perusal of the various on the accompanying drawings, one may easily see the greater functional character and the practical application characterizing the improved loom for weaving according to the present patent application.

What I claim is:

1. A loom comprising a drum rotating on a rotary shaft, means for feeding the warp threads on the drum, means for inserting weft threads into sheds formed by the warp threads, peripheral weft bobbins and means for collecting the woven cloth, said drum consisting of two first coaxial discs spaced one from the other at a predetermined distance along said shaft, a plurality of second discs arranged in rows and mounted between said two first discs, each of said second discs having a first pulley portion and a second pulley portion, the first pulley portion being of greater diameter and the second pulley portion being of smaller diameter, one of the warp threads alternately going over the pulley portion of smaller diameter and then the pulley portion of larger diameter while another warp thread alternately goes over the pulley portion of larger diameter and then the pulley portion of smaller diameter to form a crossed pattern, said second discs are carried by spindles arranged axially at equal distance from said shaft and forming a cylindrical surface coaxial with said shaft, a pair of third discs mounted on said shaft and carrying means supporting the peripheral bobbins and means for guiding and tensioning the weft threads; and means for inserting weft threads into the crossed patterns formed by said warp threads.

2. The loom according to claim 1 wherein said means inserting weft threads are mounted on a second rotatable drum coaxial with said first drum, said second drum consisting of two coaxial fourth discs, said means inserting weft threads comprise a plurality of lances mounted peripherally on said second drum and a plurality of guides mounted between said fourth discs, said lances having a projection and the loom comprises means for imparting oscillatory motion to said lances in an axial direction which comprise a third stationary drum coaxial with said second drum with a ring shaped groove which is inclined with respect to said shaft, said projections of the lances sliding in said groove, said lances oscillating upon rotation of said second drum.

3. The loom according to claim 1 wherein one of said third discs supports the peripheral bobbins and the other of said third discs supports tensioners for the weft threads and blocks for guiding and for retention of the weft threads, said blocks being in number equal to the number of said bobbins.

4. A loom according to claim 3 wherein each of the said blocks has a hollow cylindrical structure, and gripping means are located therein, said gripping means consisting of two symmetrically opposite, C-bent springs, terminating with point-shaped portions.

5. A loom according to claim 4 wherein the means for inserting the weft threads are lances and each of the said lances consists of a rod, provided with a side projection and an end fork-shaped portion adapted to engage with the C-bent springs in said block and comprising second gripping means consisting of two symmetrically opposite C-bent springs, arranged at an angle of 90° with said springs in the block.

6. The loom according to claim 5 which comprises means for cutting the weft thread after the weft thread has been inserted in the crossed patterns formed by the warp thread, said cutting means consisting of a circular knife which is mounted at the inner deadpoint of the travel of said lances.

7. The loom according to claim 5 wherein the force of the springs which constitute said second gripping means in the lances is greater than the force of the springs in said blocks.

* * * * *